US006886223B2

(12) United States Patent
Lemfeld et al.

(10) Patent No.: US 6,886,223 B2
(45) Date of Patent: May 3, 2005

(54) CONNECTING DEVICE FOR CORDS

(75) Inventors: Jan Lemfeld, Mikulaso-vice (CZ); Vaclav Kubica, Velky Senov (CZ)

(73) Assignee: Textilma AG, Stansstad (CH)

( * ) Notice: Subject to any disclaimer, the term of this patent is extended or adjusted under 35 U.S.C. 154(b) by 19 days.

(21) Appl. No.: 10/363,641

(22) PCT Filed: May 10, 2001

(86) PCT No.: PCT/CZ01/00025

§ 371 (c)(1),
(2), (4) Date: Mar. 4, 2003

(87) PCT Pub. No.: WO02/30784

PCT Pub. Date: Apr. 18, 2002

(65) Prior Publication Data

US 2003/0188795 A1 Oct. 9, 2003

(30) Foreign Application Priority Data

Oct. 11, 2000 (CZ) ..... PUV 2000-11260

(51) Int. Cl.[7] ..... F16G 11/00; D03C 3/40

(52) U.S. Cl. ..... 24/115 R; 24/616; 24/656; 403/331; 403/341; 139/59; 139/85; 139/86; 139/88

(58) Field of Search ..... 24/115 R, 616, 24/656; 403/331, 341; 139/85, 86, 88, 59, 452

(56) References Cited

U.S. PATENT DOCUMENTS

| | | | | | |
|---|---|---|---|---|---|
| 243,859 | A | * | 7/1881 | Cushing | 403/331 |
| 520,318 | A | * | 5/1894 | Nap | 24/115 R |
| 1,818,261 | A | * | 8/1931 | Koch et al. | 403/341 |
| 1,853,681 | A | * | 4/1932 | Hayes | 24/115 R |
| 5,309,950 | A | * | 5/1994 | Bassi et al. | 139/88 |
| 5,791,382 | A | * | 8/1998 | Froment et al. | 139/85 |

FOREIGN PATENT DOCUMENTS

| | | | |
|---|---|---|---|
| GB | 1413950 | * | 11/1975 |

* cited by examiner

*Primary Examiner*—Victor Sakran
(74) *Attorney, Agent, or Firm*—Dykema Gossett, PLLC

(57) ABSTRACT

The invention provides a cord tying-up connecting device including a first component (1) having a groove. One end of first component (1) includes an insertion end for insertion of a heald into the groove, while the other end includes a cam for connection with second component (2). Second component (2) is formed by a hollow body including a bilaterally coincident cam which engages with the cam for first component (1). A third component (3) includes a through-with hole and a shoulder for engagement with second component (2).

3 Claims, 4 Drawing Sheets

CONNECTING DEVICE FOR CORDS

BACKGROUND OF INVENTION a. Field of Invention

The invention relates generally to a heald and cord tying-up connecting device, and, more particularly to a heald and cord tying-up connecting device applicable for all types of tying-up.

b. Description of Related Art

A heald, also referred to as heddle, is one of a set of parallel cords or wires in a loom used to separate and guide warp threads and make a path for a shuttle.

For heald and cord tying-up injection, thus far, only a coupling with polyolefin injection, which enables only the securing of an unidirectional connection, has been used. It has been determined that this securing technique has drawbacks in that a disconnection may occur in the case of a return used material or buffing of adjoining couplings may occur during weaving. Moreover, the used material of prior-art connection devices does not provide the required frictional resistance.

SUMMARY OF INVENTION

The above-mentioned drawbacks and deficiencies have been overcome by the heald and cord tying-up connecting device in accordance with the present invention. Specifically, the heald and cord tying-up connecting device of the present invention includes three components. The first component is provided with a groove which enables placement of the first component on the heald and consequently permits motion thereof relative to the heald. One end of the first component is provided with an insertion end for the heald and another end includes a cam for connection of the first component with a second component. A second component is formed by a hollow body with a bilaterally congruent cam. The third component coincides in form with the first component and has, in addition, a through-hole for a cord tying device and a shoulder which faces the second component for fixed bilateral attachment thereof with the second component.

The device in accordance with the present invention is universal and can be used in practice for all types of tying-up. One advantage of the present invention is that all components are usable independently, which has thus far not been an option with known prior-art devices. For conventional heald and cord tying devices, a bilateral securing connection between a heald and a cord tying device has also not been possible thus far. With all components being made of a high-resistant rub-proof plastic, the device according to the present invention has a long service life even when used with a high speed weaving machine. Lastly, another advantage of the heald and cord tying-up connecting device according to the present invention is in the elimination of two separate operations, which increases productiveness and reduces laboriousness.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
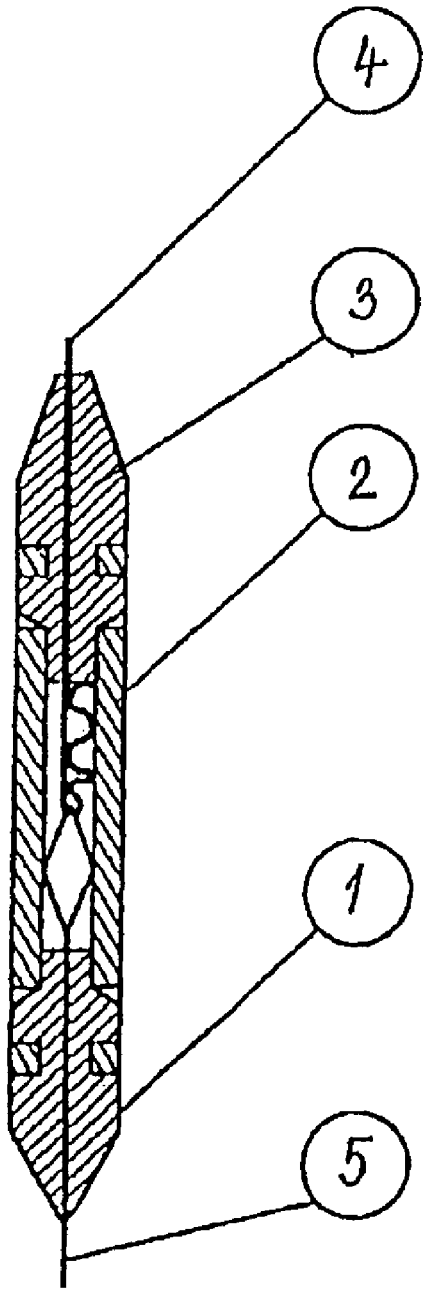
FIG. 1 illustrates a heald and cord tying-up device according to the present invention having all three components connected and both the heald and cord tying-up device in a fixed configuration.

Referring now to the drawings wherein like reference numerals designate corresponding parts throughout the several views, FIGS. 1–4 illustrate components of a heald and cord tying-up connecting device according to the present invention.

Figure 2:
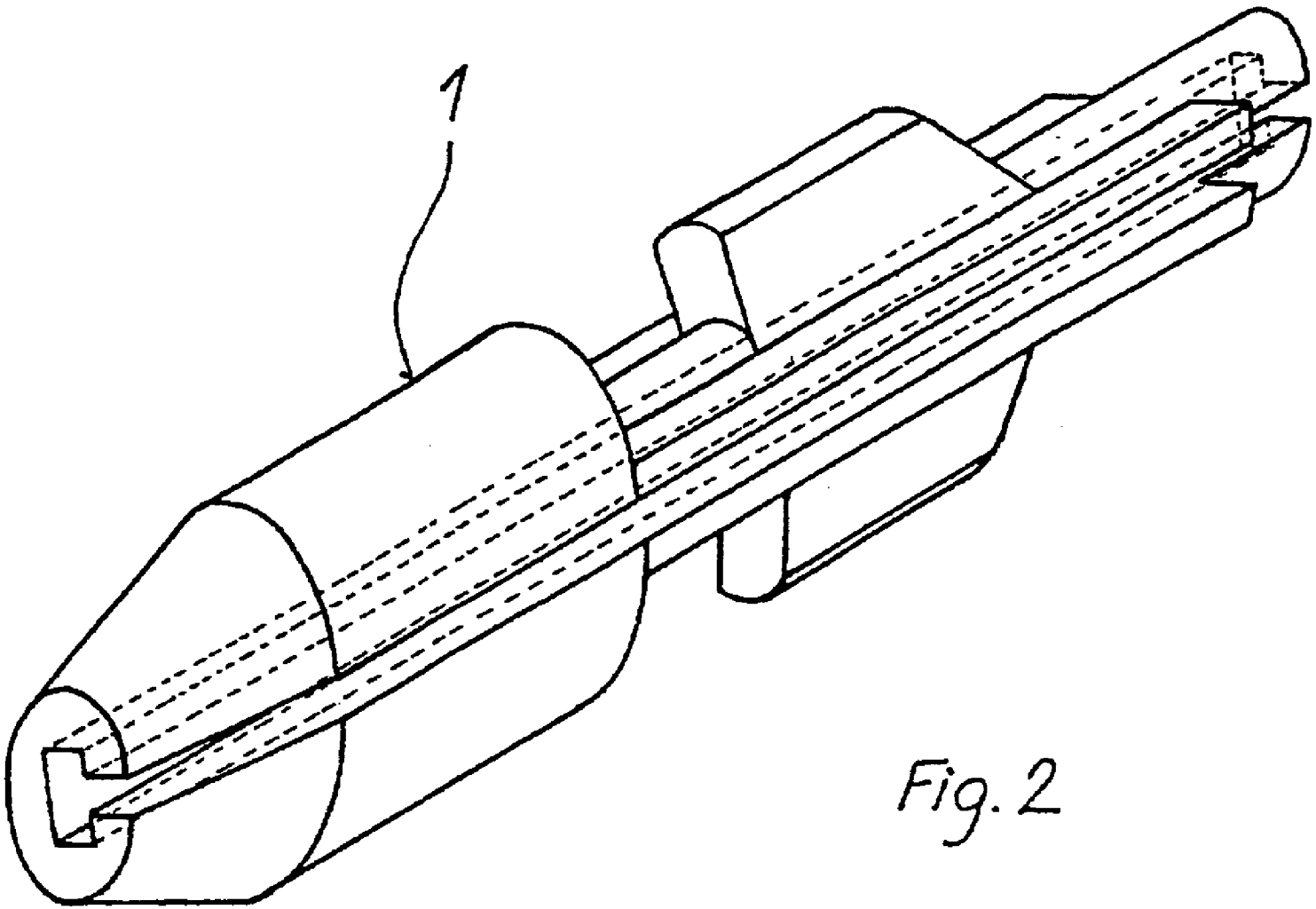
FIG. 2 illustrates the first component of the heald and cord tying-up device of FIG. 1 being provided with a groove.
Figure 3:
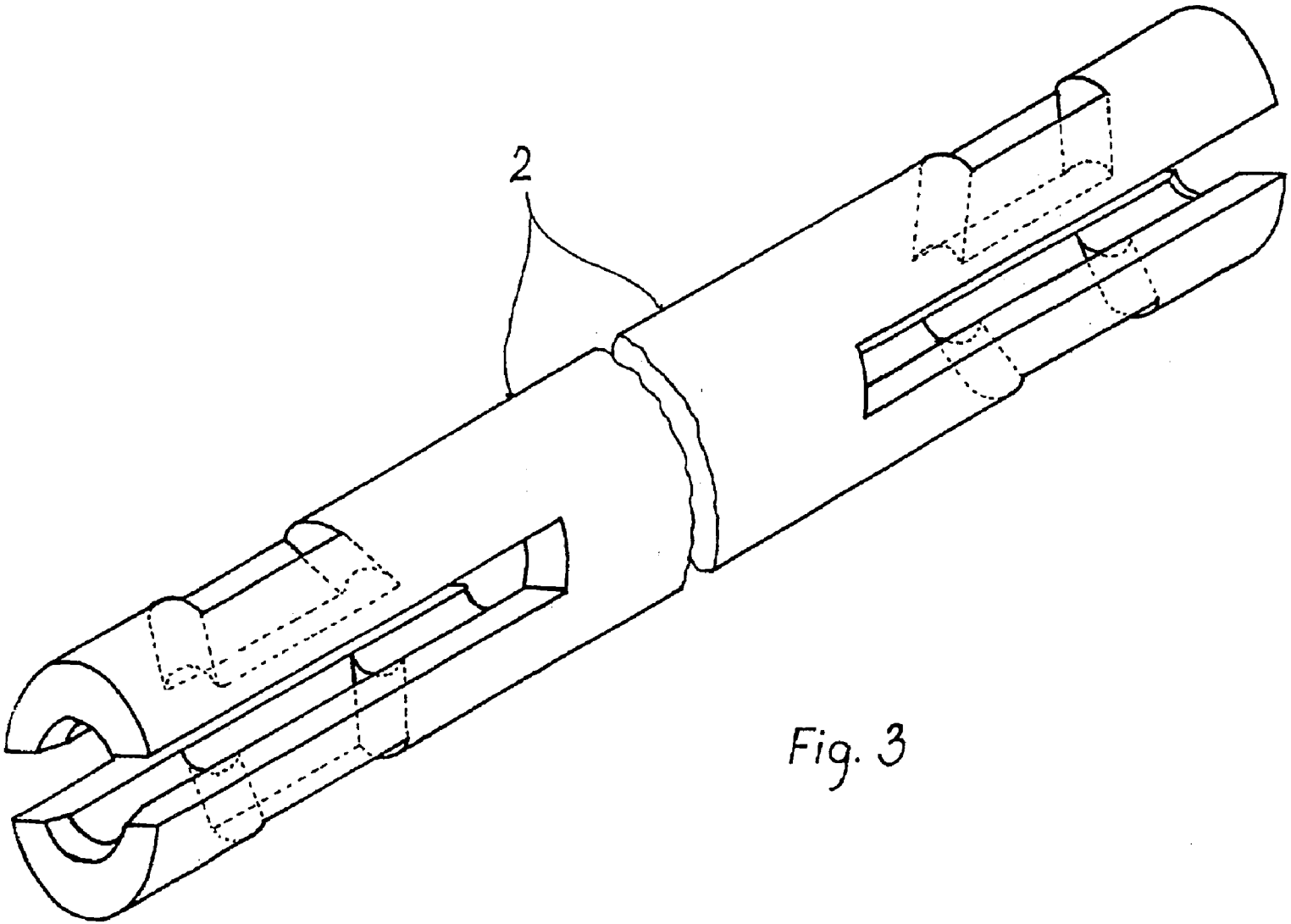
FIG. 3 illustrates the second component of the heald and cord tying-up device of FIG. 1 including a hollow body including a bilaterally congruent cam.
Figure 4:
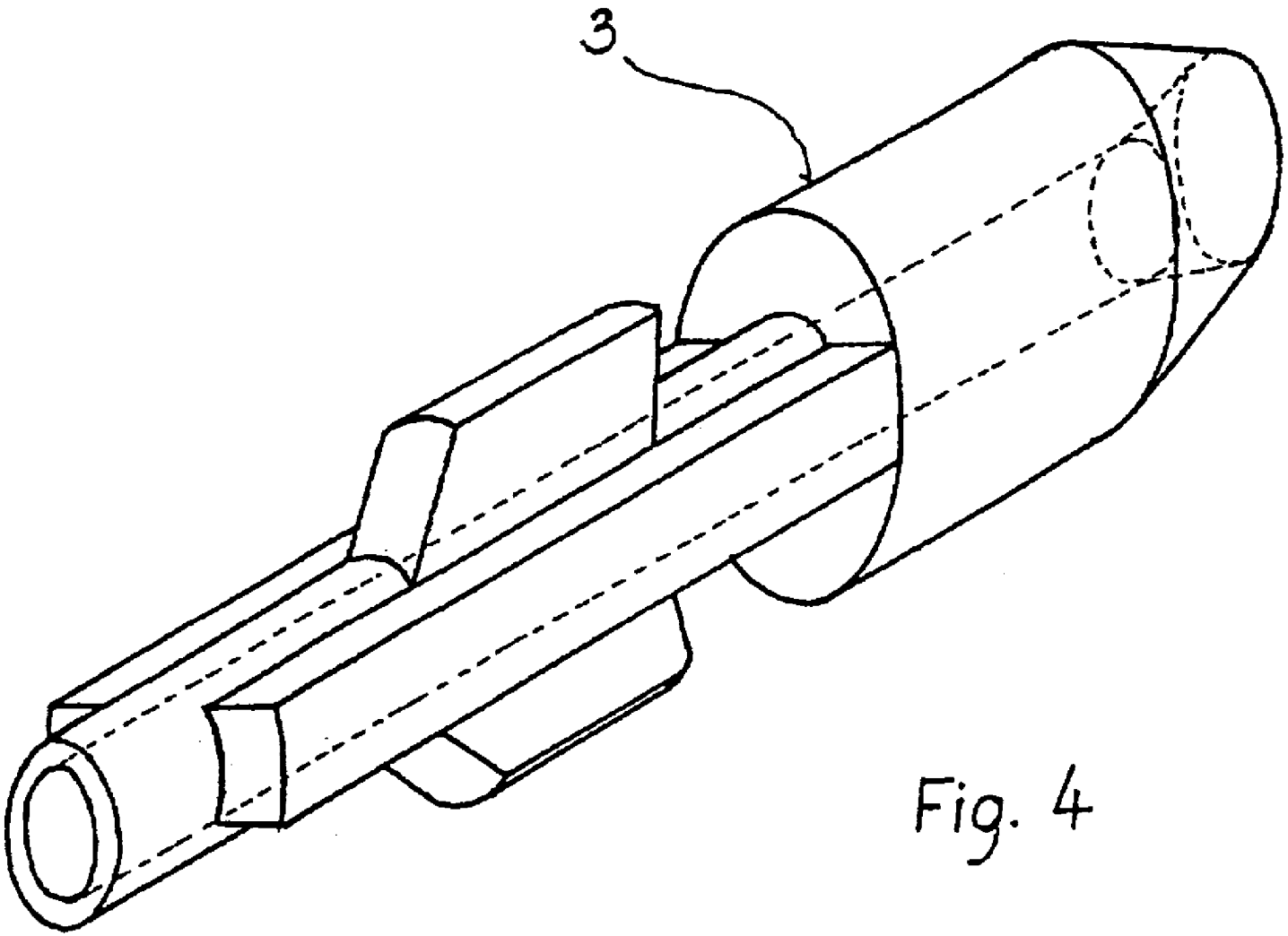
FIG. 4 illustrates the third component of the heald and cord tying-up device of FIG. 1 including a through-hole.

The heald and cord tying-up connecting device in accordance with FIG. 1 consists of three components. The first component 1, illustrated in FIGS. 1 and 2, is provided with a groove which enables placement thereof on heald 5 and translation thereof relative to heald 5. One end of first component 1 is provided with an insertion end and the other end is provided with a cam. The second component 2, illustrated in FIGS. 1 and 3, is formed by a hollow body with a bilaterally congruent cam for complementary engagement with the cam provided on first component 1. The third component 3, illustrated in FIGS. 1 and 4, coincides in form with the first component 1 and has, in addition, a through-hole for cord tying-up device 4 and a shoulder which faces towards second component 2 during engagement thereof with second component 2.

In operation, for the heald and cord tying-up connecting device according to the present invention, first component 1, having been placed on heald 5, is connected with second component 2 before leveling during the preparation phase. In this manner, a sliding motion along heald 5 is permitted. During assembly of the heald and cord tying-up connecting device, third component 3 is slid onto cord tying-up device 4. Once cord tying-up device 4 has been passed through the eye of heald 5 and aligned into the right leveling position, the remaining cord is cut off. Due to upward slippage of the sub-assembly from components 1 and 2, heald 5 and cord tying-up device 4 in second component 2 are firmly clamped. This prevents slippage of cord tying-up device 4 in heald 5. Movement of third component 3 towards second component 2 causes perfect camming of the whole connection with bilateral counter-motion locking.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A heald and cord tying-up connecting device comprising:

a first component including a groove for placement of said first component on a heald, one end of said first component including an insertion end for insertion of said heald into said groove and another end of said first component including a cam;

a second component being formed in the shape of a hollow body and including a bilaterally coincident cam, said second component being connectable with said cam provided on said first component by said bilaterally coincident cam; and a third component including a through-hole and a shoulder, said third component being engageable with said second component at said shoulder, wherein said shoulder on said third component being configured to connect with said bilaterally coincident cam on said second component.

2. A heald and cord tying-up connecting device according to claim 1, said through-hole on said third component being provided for insertion of a cord tying-up device.

3. A heald and cord tying-up connecting device according to claim 1, said first, second and third components being made of plastic.

* * * * *